US012624480B2

(12) United States Patent
Song et al.

(10) Patent No.: US 12,624,480 B2
(45) Date of Patent: May 12, 2026

(54) SHOE UPPER INCLUDING THREE-DIMENSIONAL PATTERN

(71) Applicant: Soo Bok Song, Busan (KR)

(72) Inventors: Soo Bok Song, Busan (KR); Won Seok Song, Busan (KR); Kapsoo Hwang, Busan (KR); Sinje Park, Busan (KR)

(73) Assignee: Soo Bok Song, Busan (KR)

( * ) Notice: Subject to any disclaimer, the term of this patent is extended or adjusted under 35 U.S.C. 154(b) by 370 days.

(21) Appl. No.: 18/281,132

(22) PCT Filed: May 27, 2022

(86) PCT No.: PCT/KR2022/007559
§ 371 (c)(1),
(2) Date: Mar. 18, 2024

(87) PCT Pub. No.: WO2023/287013
PCT Pub. Date: Jan. 19, 2023

(65) Prior Publication Data

US 2025/0327223 A1 Oct. 23, 2025

(30) Foreign Application Priority Data

Jul. 14, 2021 (KR) ..... 10-2021-0092195

(51) Int. Cl.
*D03D 25/00* (2006.01)
*A43B 23/02* (2006.01)
*D03D 1/00* (2006.01)

(52) U.S. Cl.
CPC ..... *D03D 25/005* (2013.01); *A43B 23/0205* (2013.01); *D03D 1/00* (2013.01); *D10B 2403/0114* (2013.01); *D10B 2501/043* (2013.01)

(58) Field of Classification Search
None
See application file for complete search history.

(56) References Cited

U.S. PATENT DOCUMENTS

2009/0191777 A1 7/2009 Liao

FOREIGN PATENT DOCUMENTS

| | | | |
|---|---|---|---|
| CN | 112680858 | * | 4/2021 |
| CN | 112981670 | * | 6/2021 |
| KR | 10-0340790 B1 | | 6/2002 |
| KR | 10-2009-0104502 A | | 10/2009 |
| KR | 10-2016-0018205 A | | 2/2016 |
| KR | 10-1590265 B1 | | 2/2016 |
| KR | 10-2017-0077633 A | | 7/2017 |

OTHER PUBLICATIONS

Machine Translation of CN112981670 (Year: 2021).*
Machine Translation of CN112680858 (Year: 2021).*
International Search Report from corresponding PCT Application No. PCT/KR2022/007559, Dated Sep. 6, 2022.

* cited by examiner

*Primary Examiner* — Shawn Mckinnon
(74) *Attorney, Agent, or Firm* — Harness, Dickey & Pierce, P.L.C.

(57) ABSTRACT

The present disclosure provides a shoe upper woven using a warp yarn and a weft yarn, having the weft yarn formed so that a first weft yarn which is a high-stretch yarn and the second weft which is a regular yarn overlap each other, and including a three-dimensional pattern region in which the first weft yarn is disposed on a rear surface and the second weft yarn is disposed on a surface to form the three-dimensional pattern on the surface.

9 Claims, 4 Drawing Sheets

SHOE UPPER INCLUDING THREE-DIMENSIONAL PATTERN

CROSS-REFERENCE TO RELATED APPLICATIONS

This application is a national phase application of PCT Application No. PCT/KR2022/007559, filed on 27 May 2022, which claims the benefit of and priority to German Patent Application No. 10-2021-0092195, filed on 14 Jul. 2021. The entire disclosures of the applications identified in this paragraph are incorporated herein by references.

TECHNICAL FIELD

The present disclosure relates to a shoe upper, and more particularly, to a shoe upper including a three-dimensional pattern.

BACKGROUND

Generally, shoes include a sole that is in contact with the ground and shoe uppers that are combined with the sole and cover feet of a wearer.

In order to improve the manufacturing convenience and manufacturing efficiency of such shoes, the shoe upper may be woven integrally. Details regarding the shoe upper woven integrally are described in Korean Patent No. 10-1437472 (Aug. 28, 2014). In addition, a loom for weaving heterogeneous tissue fabrics, and shoe uppers and shoes woven using the same are described in detail in Korean Patent No. 10-1557130 (Sep. 24, 2015).

However, in order to insert a pattern such as a logo into the shoe upper, a separate sewing operation is required to sew and attach a separately manufactured pattern member to the shoe upper. In particular, in order to insert a three-dimensional pattern into the shoe upper, a process of manufacturing the three-dimensional pattern and a process of sewing and attaching the three-dimensional pattern produced in this way to the shoe upper are required, which is very complicated and increases the manufacturing cost.

SUMMARY

According to an aspect of the present disclosure, there is provided a shoe upper including a three-dimensional pattern, in which the shoe upper is woven using a warp yarn and a weft yarn, a first weft yarn which is a high-stretch yarn and a second weft which is a regular yarn overlap each other to form the weft yarn, and the shoe upper includes a three-dimensional pattern region in which the first weft yarn is disposed on a rear surface and the second weft yarn is disposed on a surface to form the three-dimensional pattern on the surface.

The shoe upper including the three-dimensional pattern according to present disclosure includes the three-dimensional pattern formed during the weaving process of fabric without a separate sewing process.

Since the shoe upper including the three-dimensional pattern according to the present disclosure includes plain weave fabric and/or leno weave fabric continuously woven through a jacquard process, various and complicated three-dimensional patterns are provided.

DETAILED DESCRIPTION

Hereinafter, an embodiment of the present disclosure will be described in detail with reference to the accompanying drawings.

In this specification, fabrics are largely divided into a plain weave and a twisted weave.

In the present specification, the plain weave refers to a fabric made by weaving warp yarn and weft yarn side by side with each other, and a three-way organization represented by a plain weave, a twill weave, and a satin weave corresponds to this.

In this specification, the twisted weave refers to a fabric in which weft yarns are formed side by side, but warp yarns are twisted at regular intervals; and a leno weave in which two warp yarns form a pair centered on the weft yarn and are twisted while crossing each other to form an opening, and the weft yarn that is woven through the opening corresponds to the twisted weave.

Figure 1:
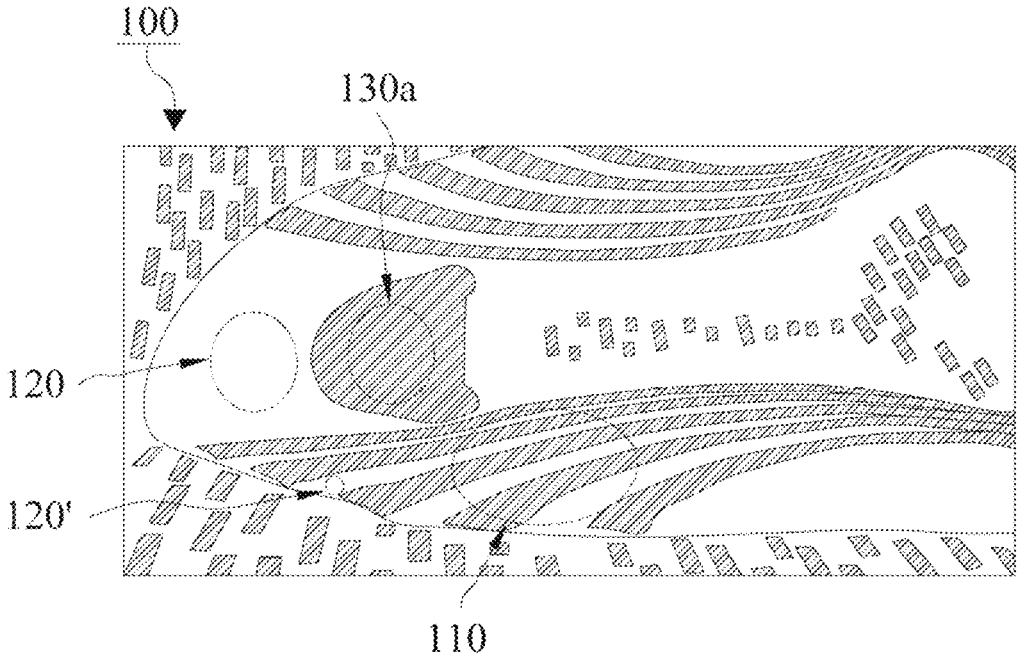
FIG. 1 is a view schematically illustrating a shoe upper according to one embodiment of present disclosure.

FIG. 1 is a view schematically illustrating a shoe upper according to one embodiment of present disclosure.

Figure 2:
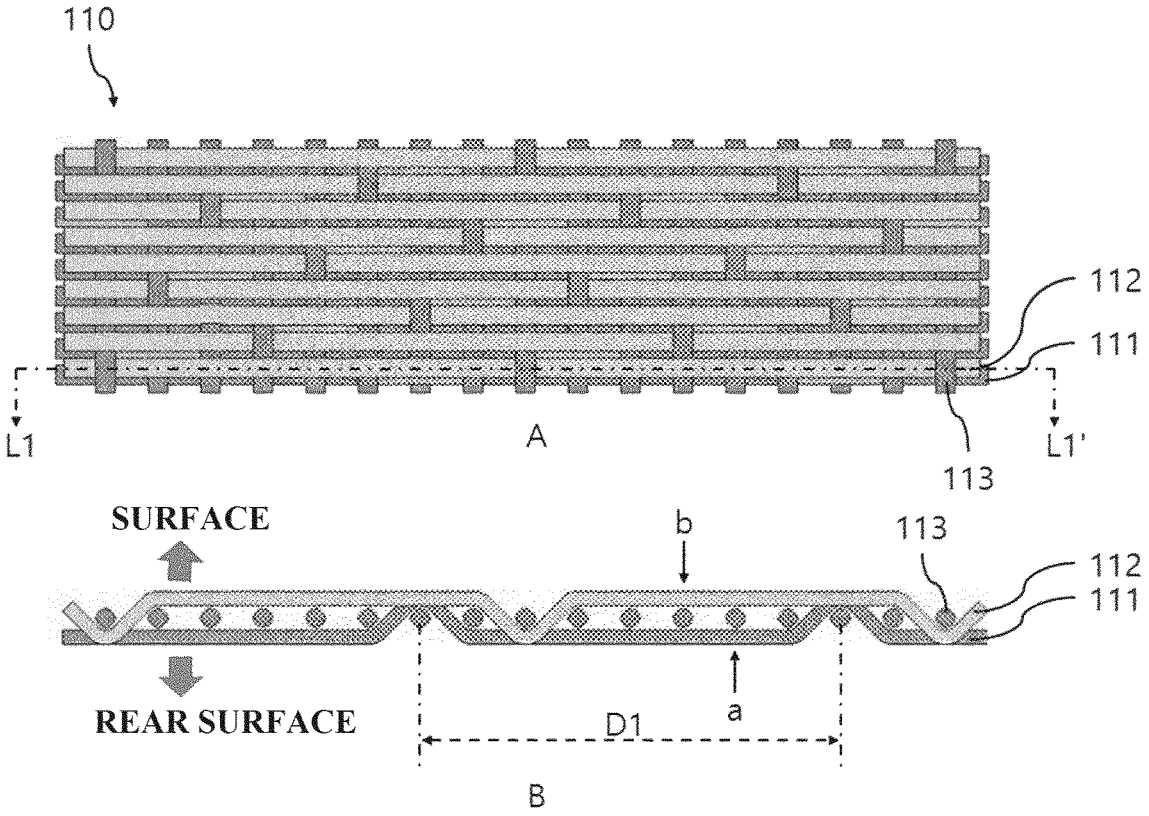
FIG. 2 is a view schematically illustrating a weaving structure of a plain weave three-dimensional pattern region of a shoe upper according to one embodiment of the present disclosure.

FIG. 2 is a view schematically illustrating a weaving structure of a plain weave three-dimensional pattern region of a shoe upper according to one embodiment of the present disclosure. Specifically, FIG. 2A is a plan view of the plain weave three-dimensional pattern region, and FIG. 2B is a schematic cross-sectional view taken along line L1-L1' of FIG. 2A.

Figure 3:
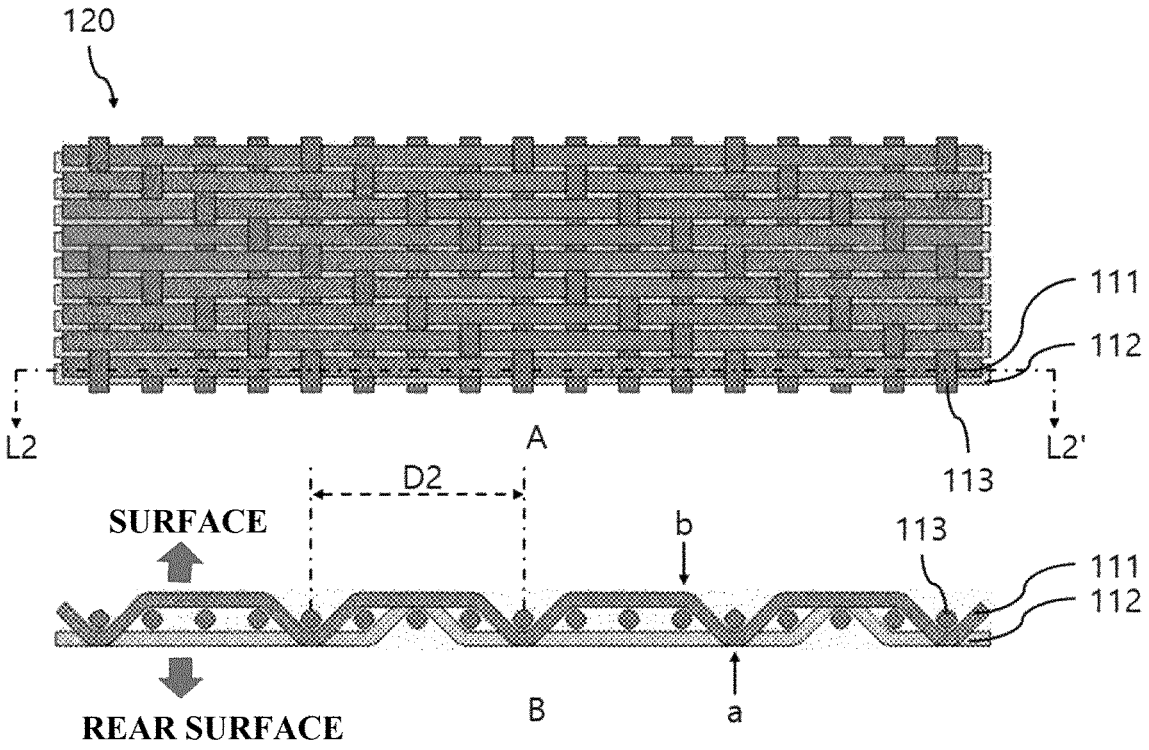
FIG. 3 is a view schematically illustrating a weaving structure of a plain weave flat pattern region of a shoe upper according to one embodiment of the present disclosure.

FIG. 3 is a view schematically illustrating a weaving structure of a plain weave flat pattern region of a shoe upper according to one embodiment of the present disclosure. Specifically, FIG. 3A is a plan view of the plain weave flat pattern region, and FIG. 3B is a schematic cross-sectional view taken along line L2-L2' of FIG. 3A.

Figure 4:
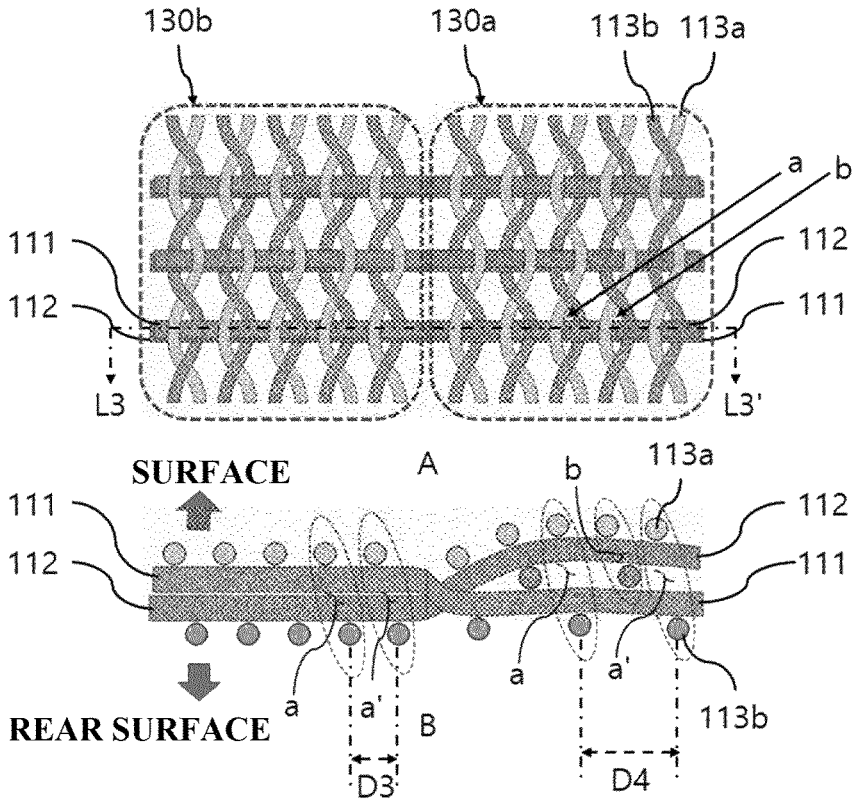
FIG. 4 is a view schematically illustrating weaving structures of a leno weave three-dimensional pattern region and a leno weave flat pattern region of a shoe upper according to one embodiment of the present disclosure.

FIG. 4 is a view schematically illustrating weaving structures of a leno weave three-dimensional pattern region and a leno weave flat pattern region of a shoe upper according to one embodiment of the present disclosure. Specifically, FIG. 4A is a plan view of the leno weave three-dimensional pattern region and the leno weave flat pattern region, and FIG. 4B is a schematic cross-sectional view taken along L3-L3' of FIG. 4A.

Referring to FIGS. 1 to 4, a shoe upper 100 including a three-dimensional pattern according to one embodiment of one aspect of the present disclosure is woven using a warp yarn 113 and weft yarns 111 and 112. As will be described in more detail below, the shoe upper 100 according to the present disclosure is a shoe upper in which plain weave fabric woven with a plain weave and leno weave fabric woven with a leno weave are continuously woven.

Here, the weft yarns 111 and 112 of the present disclosure are formed by overlapping a first weft yarn 111 which is a high-stretch yarn and a second weft yarn 112 which is a regular yarn. As the high-stretch yarn constituting the first weft yarn 111, for example, polyurethane high-stretch yarn may be used, and as the regular yarn constituting the second weft yarn 112, for example, normal polyester false twist yarn or polyester reclaimed yarn may be used, but they are not limited thereto.

Meanwhile, at least one warp yarn may be a transparent yarn.

In addition, the shoe upper of the present disclosure is three-dimensional pattern regions 110 and 130*a* in which the first weft yarn 111 is disposed on a rear surface and the second weft yarn (112) is disposed on a surface to form a three-dimensional pattern on the surface.

In this specification, unless otherwise specified, the surface means one surface of the shoe upper that is exposed to the outer surface of the shoe, and the rear surface means the other surface of the shoe upper that goes inside the shoe and is not exposed to the outer surface of the shoe.

In the three-dimensional pattern regions 110 and 130*a* forming the three-dimensional pattern on the surface of the shoe upper, the second weft yarn 112 which is a regular yarn is disposed to be exposed on the surface of the shoe upper, and the first weft yarn 111 which is the high-stretch yarn is disposed on the rear surface. With this configuration, as the first weft yarn 111, which is the high-stretch yarn disposed on the rear surface of the shoe upper, contracts, the second weft yarn 112, which is the regular yarn disposed on the surface of the shoe, does not contract and protrudes, and thus, the three-dimensional pattern is formed on the surface of the shoe upper.

In another embodiment of the present disclosure, the shoe upper of the present disclosure further includes flat pattern regions 120 and 130*b* in which the first weft yarn 111 is disposed on the surface and the second weft yarn 112 is disposed on the rear surface so as not to form a three-dimensional pattern on the surface.

In the flat pattern regions 120 and 130*b* that do not form the three-dimensional pattern on the surface of the shoe upper, the first weft yarn 111, which is a high-stretch yarn, is disposed to be exposed on the surface of the shoe upper, and the second weft yarn 112, which is a regular yarn, is disposed on the rear surface. With this configuration, as the first weft yarn 111, which is disposed on the surface of the upper shoe and is a high-stretch yarn, contracts, the three-dimensional pattern is not formed on the upper surface of the shoe. At this time, the second weft yarn 112, which is a regular yarn, may not contract and may protrude to the rear surface of the shoe upper.

In another embodiment of the present disclosure, the three-dimensional pattern region and the flat pattern region of the shoe upper of the present disclosure are continuously woven without sewing. As illustrated in FIG. 4, at a portion where the three-dimensional pattern region and the flat pattern region come into contact with each other, the first weft yarn 111 and the second weft yarn 112 are twisted and supplied so that their positions cross each other, for example, the first weft yarn 111 disposed on the upper surface is disposed on the rear surface of the shoe upper, and the second weft yarn 112 disposed on the rear surface of the shoe upper is disposed on the surface of the shoe upper. Although not illustrated in FIGS. 2 and 3, as illustrated in FIG. 4, the first weft yarn 111 and the second weft yarn 112 may be configured to alternate arrangement positions by crossing each other.

Here, the three-dimensional pattern region and the flat pattern region may be jacquard fabrics woven for a jacquard loom.

In general, fabrics are made according to a method of passing the warp yarn through a heald eye located in a center of a heald so that the warp yarn can pass through, raising and lowering the warp yarn by a vertical movement of the heald, forming an opening between neighboring warp yarns, and inserting the weft yarn in the opening. The fabrics can be divided into dobby fabrics that can be woven with simple structures or small patterns, and jacquard fabrics that can be woven with large or complex patterns, depending on a type of an opening device. In the jacquard fabric, each warp yarn is controlled by an independent heald, the heald is not fixed to a heald frame but moves up and down independently to control a heald movement to form openings between the warp yarns, and weft yarns that are inserted into the formed openings are woven by the jacquard loom for weaving the fabrics. The jacquard fabric has an advantage of being capable of forming various and complex patterns.

FIG. 2 is a view schematically illustrating a weaving structure of the plain weave three-dimensional pattern region of the shoe upper according to one embodiment of the present disclosure, and FIG. 3 is a view schematically illustrating a weaving structure of the plain weave flat pattern region of the shoe upper according to one embodiment of the present disclosure.

Referring to FIGS. 2 and 3, in the shoe upper according to another embodiment of the present disclosure, the three-dimensional pattern region and the flat pattern region includes the plain weave three-dimensional pattern region 110 woven and the plain weave flat pattern region 120 with plain weave, respectively.

Here, the warp yarn 113 and the first weft yarn 111 are disposed so that tissue point values of the warp yarn 113 and the first weft yarn 111 is smaller in the plain weave three-dimensional pattern region 110 than in the plain weave flat pattern region 120.

In the present disclosure, the tissue point value is a numerical value illustrating the degree to which warp yarns and weft yarns intersect and participate in the tissue on the fabric tissue, and is a numerical value expressed by setting the numerator as 1 when the warp yarn and the weft yarn intersect on the fabric structure and the number of warp yarns in the repeating unit constituting the tissue as the denominator. For example, in the case of a plain weave, since the number of warp yarns [1up 1down] in the repeating unit constituting the tissue is 2, the tissue point value of the plain weave is ½, and the plain weave has the largest tissue point value and is the strongest tissue. In addition, in the case of 4 twill weave of 3up 1down, which is a 4-sheet tissue, the tissue point value is ¼, and in the case of 8-twill weave of 7up 1down (7up 1down) of an 8-sheet tissue, the tissue point value is ⅛. Therefore, a small tissue point value means that the tissue of the fabric is sparsely woven.

Referring to FIG. 2, the warp yarn 113 and the first weft yarn 111 are 7up 1down tissues when viewed in the direction indicated by an arrow a, and thus, the tissue point value thereof is ⅛. At this time, since the first weft yarn 111, which is a high-stretch yarn, is bound at another down point adjacent to the down point of the warp yarn, it can be contracted by the distance indicated by D1.

Meanwhile, referring to FIG. 3, since the warp yarn 113 and the first weft yarn 111 are 3up 1down tissues when viewed in the direction indicated by an arrow b, and the tissue point value thereof is ¼. At this time, since the first weft yarn 111, which is a high-stretch yarn, is bound at another down point adjacent to the down point of the warp yarn, it can be contracted by the distance indicated by D2.

Therefore, since the distance indicated by D1 is greater than the distance indicated by D2, the first weft yarn 111 in the plain weave three-dimensional pattern region 110 in which warp yarns and weft yarns are disposed to secure the distance indicated by D1 can contract more than the first weft yarn 111 in the plain weave flat pattern region 120, and thus, the second weft yarn 112 protrudes further to the surface to maximize the effect of the three-dimensional pattern.

Therefore, since the warp yarn 113 and the first weft yarn 111 are disposed so that the tissue point values of the warp yarn 113 and the first weft yarn 111 are smaller in the plain weave three-dimensional pattern region 110 (tissue point value ⅛ in FIG. 2) than in the plain weave flat pattern region (120) (tissue point value ¼ in the case of FIG. 3), in the plain weave three-dimensional pattern region 110, the second weft yarn 112 protrudes further to the surface to maximize the effect of the three-dimensional pattern.

Referring FIGS. 2 and 3, in the shoe upper according to another embodiment of the present disclosure, the warp yarn 113 and the second weft yarn 112 are disposed so that the tissue point values of the warp yarn 113 and the second weft yarn 112 are same in the plain weave three-dimensional pattern region 110 and the plain weave flat pattern region 120.

That is, the warp yarn 113 and the first weft yarn 111 are disposed so that the tissue point values of the warp yarn 113 and the first weft yarn 111 are smaller in the plain weave three-dimensional pattern region 110 than in the plain weave flat pattern region 120, and the warp yarn 113 and the second weft yarn 112 are disposed so that the tissue point values of the warp yarn 113 and the second weft yarn 112 are same in the plain weave three-dimensional pattern region 110 and the plain weave flat pattern region 120. Therefore, the second weft yarn 112, which is a regular yarn, is bound at another down point adjacent to the down point of the warp yarn at the same distance, only the contraction distance of the first weft yarn 111 which is a high-stretch yarn is changed, and it is possible to maximize the three-dimensional pattern effect.

Referring to FIGS. 2 and 3, in the shoe upper according to another embodiment of the present disclosure, in the plain weave flat pattern region 120, the warp yarn 113 and the weft yarns 111 and 112 are disposed so that the tissue point values of the warp yarn 113 and the first weft yarn 111 are equal to or greater than the tissue point values of the warp yarn 113 and the second weft yarn 112. The first weft yarn 111, which is a high-stretch yarn, is contracted (does not protrude), and the second weft yarn 112, which is a regular yarn, protrudes when the first weft yarn 111 is contracted. However, in the plain weave flat pattern region 120, since the second weft yarn 112 disposed on the rear surface of the shoe upper does not need to protrude, the first weft yarn 111, which is a high-stretch yarn, is arranged to be more tightly bound by the warp yarn than the second weft yarn 112, which is a regular yarn, so that the plain weave flat pattern region 120 may be formed flat.

FIG. 4 is a view schematically illustrating a weaving structure of a leno weave three-dimensional pattern region and a leno weave flat pattern region of the shoe upper according to one embodiment of the present disclosure.

Referring to FIG. 4, in the shoe upper according to another embodiment of the present disclosure, the warp yarn includes a first warp yarn 113*a* and a second warp yarn 113*b*, the first warp yarn 113*a* and the second warp yarns 113*b* are twisted while crossing each other oppositely to form openings a and b, and the weft yarn passes through the opening to form the leno weave fabric.

The leno weave fabric is woven so that two warp yarns form a pair centered on the weft yarn and are twisted while crossing each other, and in general, the first warp yarn is configured to always pass over the weft yarn, and the second warp yarn always passes under the weft yarn.

Here, the opening includes a first opening a through which the first weft yarn 111 and the second weft yarn 112 pass together, and a second opening b through which only the second weft yarn 112 passes.

Meanwhile, the three-dimensional pattern region and the flat pattern region include a leno weave three-dimensional pattern region 130*a* and a leno weave flat pattern region 130*b* woven with a leno weave, respectively.

Here, the leno weave three-dimensional pattern region 130*a* is configured such that one or more second openings b are disposed between the first opening a and another first opening a' adjacent to the first opening a. Since the first weft yarn 111, which is a high-stretch yarn, is bound by the first opening a and the another first opening a' adjacent to the first opening a, the first weft yarn 111 can be contracted by a distance indicated by D4 in FIG. 4. Therefore, as the distance indicated by D4 increases, the shrinkable distance of the first weft yarn 111, which is a high-stretch yarn, increases. As such, the second weft yarn 112, which is a regular yarn, can protrude further, which maximizes the effect of the three-dimensional pattern.

Referring to FIG. 4, in the shoe upper according to another embodiment of the present disclosure, the warp yarn and the weft yarn are disposed so that the number of the second openings b existing between the first opening a and the another first opening a' adjacent the first opening a is greater in the leno weave three-dimensional pattern region 130*a* than in the leno weave flat pattern region 130*b*.

As illustrated in FIG. 4, in the case of the leno weave flat pattern region 130*b*, since the first weft yarn 111 is bound by the first opening a and the another first opening a' adjacent to the first opening a, the first weft yarn 111 can shrink by the distance indicated by D3 in FIG. 4. Therefore, since the distance indicated by D4 is greater than the distance indicated by D3, the first weft yarn 111 in the leno weave three-dimensional pattern region 130*a* in which the warp yarn and the weft yarn are disposed to secure the distance indicated by D4 can contract more than the first weft yarn 111 in the leno weave flat pattern region 130*b*, the second weft yarn 112 protrudes further to the surface to maximize the effect of the three-dimensional pattern.

Meanwhile, in another embodiment, in the leno weave flat pattern region 130*b*, the warp yarn and the weft yarn are disposed so that the second opening b does not exist between the first opening a and another first opening a' adjacent to the first opening. In the leno weave flat pattern region 130*b*, since the second weft yarn 112 disposed on the rear surface of the shoe upper does not need to protrude, the first weft yarn 111, which is a high-stretch yarn, and the second weft yarn 112, which is a regular yarn, are woven together through the opening formed by the first warp yarn 113*a* and the second warp yarn 113*b*, and the leno weave flat pattern region 130*b* may be formed flat.

Meanwhile, in another embodiment, in the shoe upper according to another embodiment of the present disclosure, the three-dimensional pattern region includes a plain weave three-dimensional pattern region woven with a plain weave and a leno weave three-dimensional pattern region woven with a leno weave, the flat pattern region includes a plain weave flat pattern region woven with a plain weave and a leno weave flat pattern region woven with leno weave, and the plain weave three-dimensional pattern region, the plain weave flat pattern region, and the leno weave three-dimensional pattern region is continuously woven without sewing.

What is claimed is:

1. A shoe upper including a three-dimensional pattern, wherein the shoe upper is woven using a warp yarn and a weft yarn, a first weft yarn which is a high-stretch yarn and the second weft which is a yarn overlap each other to form the weft yarn, wherein the shoe upper comprises a three-dimensional pattern region in which the first weft yarn is disposed on a rear surface and the second weft yarn is disposed on an upper to form the three-dimensional pattern on the surface, and wherein the shoe upper further comprises a flat pattern region in which the first weft yarn is disposed on the upper surface, the second weft yarn is disposed on the rear surface, and the three-dimensional pattern is not formed on the upper surface.

2. The shoe upper of claim 1, wherein the three-dimensional pattern region and the flat pattern region are continuously woven without sewing.

3. The shoe upper of claim 1, wherein the three-dimensional pattern region and the flat pattern region include a plain weave three-dimensional pattern region and a plain weave flat pattern region woven with a plain weave, respectively, and tissue point values of the warp yarn and the first weft yarn are smaller in the plain weave three-dimensional pattern area than in the plain weave flat pattern area.

4. The shoe upper of claim 3, wherein the tissue point values of the warp yarn and the second weft yarn are the same in the plain weave three-dimensional pattern region and the plain weave flat pattern region.

5. The shoe upper of claim 3, wherein in the plain weave flat pattern region, the tissue point values of the warp yarn and the first weft yarn are equal to or greater than the tissue point values of the warp yarn and the second weft yarn.

6. The shoe upper of claim 1, wherein the warp yarn includes a first warp yarn and a second warp yarn, the first warp yarn and the second warp yarn are twisted while crossing each other oppositely to form an opening, and the weft yarn pass through the opening to from a leno weave fabric, the opening includes a first opening through which the first weft yarn and the second weft yarn pass together and a second opening through which only the second weft yarn passes, the three-dimensional pattern region and the flat pattern region include a leno weave three-dimensional pattern region and a leno weave flat pattern region woven with a leno weave, respectively, and in the leno weave three-dimensional pattern region, one or more second openings are disposed between a first opening and another first opening adjacent to the first opening.

7. The shoe upper of claim 6, wherein the number of second openings existing between the first opening and the another first opening adjacent to the first opening is greater in the leno weave three-dimensional pattern region than in the leno weave flat pattern region.

8. The shoe upper of claim 6, wherein in the leno weave flat pattern region, the second opening does not exist between the first opening and another first opening adjacent to the first opening.

9. The shoe upper of claim 2, wherein the three-dimensional pattern region includes a plain weave three-dimensional pattern region woven with a plain weave and a leno weave three-dimensional pattern region woven with a leno weave, the flat pattern region includes a plain weave flat pattern region woven with a plain weave and a leno weave flat pattern region woven with a leno weave, and the plain weave three-dimensional pattern region, the plain weave flat pattern region, and the leno weave three-dimensional pattern region are continuously woven without sewing.

* * * * *